United States Patent [19]

Ng et al.

[11] Patent Number: 4,654,282

[45] Date of Patent: Mar. 31, 1987

[54] PLURAL ELECTROPHOTOGRAPHIC TONED IMAGE METHOD

[75] Inventors: Yee S. Ng, Fairport; Louis J. Rossi, Rochester; Domenic Santilli, Webster, all of N.Y.

[73] Assignee: Eastman Kodak Company, Rochester, N.Y.

[21] Appl. No.: 858,489

[22] Filed: May 1, 1986

[51] Int. Cl.[4] ..... G03G 13/22

[52] U.S. Cl. ..... 430/54; 430/44; 430/97; 355/4

[58] Field of Search ..... 430/54, 44, 43, 97; 355/4

[56] References Cited

U.S. PATENT DOCUMENTS

| | | | |
|---|---|---|---|
| 3,549,447 | 12/1970 | Bresnick | 156/230 |
| 3,928,033 | 12/1975 | Anzai | 96/1.2 |
| 4,052,325 | 10/1977 | Santilli | 430/114 |
| 4,145,299 | 3/1979 | Ford, Jr. et al. | 430/114 |
| 4,202,785 | 5/1980 | Merrill et al. | 430/106 |
| 4,414,152 | 11/1983 | Santilli et al. | 260/185 |
| 4,504,084 | 3/1985 | Jauch | 283/94 |
| 4,510,223 | 4/1985 | Kuehnle et al. | 430/44 |

FOREIGN PATENT DOCUMENTS

| | | |
|---|---|---|
| 637014 | 2/1962 | Canada . |
| 1035837 | 7/1966 | United Kingdom . |

*Primary Examiner*—J. David Welsh

*Attorney, Agent, or Firm*—David F. Janci

[57] ABSTRACT

The invention provides an electrophotographic method of forming a subsequent toner image overlapping one or more toner images previously formed on a surface of an electrophotographic element.

The method comprises the steps of:

(a) electrically charging the surface and the previously formed toner image or images, (b) forming an electrostatic latent image overlapping the previously formed toner image or images on the surface by imagewise exposing the element, through the previously formed toner image or images, to actinic radiation of a wavelength outside the range of 400 to 700 nanometers; the density of the previously formed toner image or images to the actinic radiation being less than about 0.2, and (c) electrographically developing the electrostatic latent image to thereby form the subsequent toner image.

15 Claims, No Drawings

PLURAL ELECTROPHOTOGRAPHIC TONED IMAGE METHOD

FIELD OF THE INVENTION

This invention relates to an electrophotographic method of forming a plurality of overlapping toner images on a surface. More particularly, the method involves forming subsequent toner images overlapping previously formed toner images on an electrophotographic element, by imagewise exposing the element to actinic radiation that passes through the previously formed toner images without being significantly attenuated by those images.

BACKGROUND

In electrophotography an image comprising an electrostatic field pattern, usually of non-uniform strength (also referred to as an electrostatic latent image), is formed on an insulative surface of an electrophotographic element comprising a photoconductive layer and an electrically conductive substrate. The electrostatic latent image is usually formed by imagewise radiation-induced dissipation of the strength of portions of an electrostatic field of uniform strength previously formed on the insulative surface. Typically, the electrostatic latent image is then developed into a toner image by contacting the latent image with an electrographic developer. If desired, the latent image can be transferred to another surface before development.

When it is desired to use electrophotographic methods to form a composite image comprising a plurality of overlapping toner images ("overlapping" meaning lying, in whole or in part, over each other), e.g., to annotate a previous image record or to form a multicolor image record such as, for example, a multicolor proof, various alternatives are available.

One such alternative is to form separate single toner images on separate transparent supports and then overlay a plurality of these separate image-bearing supports, in proper registration, to form a multiple toner image. This is an involved process requiring careful registration with previous images, and, because each successive image is physically separated from previous images by at least one support, even when virtually perfect registration has been actually achieved, the images may appear to be out of registration, depending upon the angle of viewing and other factors.

Another alternative, which avoids supports between the images, involves electrophotographically forming a toner image singly and transferring the image to a receiving element while in proper registration with toner images previously sequentially formed and transferred to the receiving element. However, such a method requires that each successive toner image be kept in proper registration with previously transferred images during its transfer from the electrophotograhic element to the receiving element. Maintaining such registration during toner transfer is an inherently slow and difficult process and is dependent upon virtually absolute dimensional stability of the electrophotographic element and the receiver element during each transfer step. It should be appreciated that it is difficult to prevent stretching, shrinkage, or other distortion of the elements while they are subjected to pressure, heat, or liquid contact during development or transfer. When such distortion occurs, registration is adversely affected.

Other methods are known, which do not require registration during toner transfer and, thus, avoid the problems inherent therein. For example, U.S. Pat. No. 3,928,033 and British Pat. No. 1,035,837 describe methods of repetitively charging, exposing, and developing electrophotographic elements to form multiple overlapping toner images thereon. Each separate image is fixed in place before each succeeding cycle is carried out, and no transfer of toner images to a separate receiver element is intended; the electrophotographic element serves as the final image-bearing element. While problems of registration during transfer are thus avoided, there are other problems associated with such methods. The photoconductive layer of elements used in such methods significantly absorb visible light (since the actinic radiation employed in each imagewise exposure in those methods is visible light), and therefore, the photoconductive layers inherently impart an overall background tint or density to the final images when viewed. This can be very undesirable for some applications, e.g., where the intention is to produce a color proof to simulate intended press print quality and to allow evaluation of the color quality of original color separation negatives. Furthermore, in the methods of those two patents imagewise exposures subsequent to the first are carried out with actinic visible light that must pass through the previously deposited toner image or images before it can reach the photoconductive layer to produce selective charge dissipation. It should be appreciated that at some point in each of those methods the imagewise visible exposing light will either be undesirably attenuated by the previously deposited toner images (which are visibly colored and thus inherently block transmission of some visible light) thus causing false latent images to be created, or, alternatively, the previously deposited toner images will not in fact have been actually representative of the hues they were intended to represent. For example, in British Pat. No. 1,035,837 the order of imaging described is to produce cyan, then magenta, then black, and, finally, yellow toner images in overlapping configuration. in order to produce the yellow image, a visible actinic light exposure is intended to pass through the previous toner images, including the black image. No matter what the visible wavelength or wavelengths of that visible actinic light are, the light will either be undesirably attenuated nonuniformly by the black toner image to cause false imaging, or the black toner will not have been a true black as intended, since an image that truly appears black must inherently absorb light significantly throughout the visible spectrum (i.e., throughout the range of wavelengths from 400 to 700 nanometers). The same sort of problem is inherent in the disclosure of U.S. Pat. No. 3,928,033, wherein the order of imaging described is to produce yellow, then magenta, then cyan, and, finally, black toner images in overlapping configuration. The patent teaches use of white light in the final exposure step involved in producing the black toner image. It should be evident that each of the previously deposited yellow, magenta, and cyan toner images will undesirably attenuate that light nonuniformly on its way to the photoconductive layer and cause some degree of false imaging.

Another method, which also forms multiple overlapping toner images directly on an electrophotographic element, but which clearly avoids the problems inherent in the methods of the U.S. and British patents just discussed, is described in allowed U.S. patent application Ser. No. 773,528, filed Sept. 6, 1985, the disclosure of which is hereby incorporated herein by reference. In the method of that application an electrophotographic element is employed, wherein the electrically conductive substrate is transparent to the actinic exposing radiation intended to be used. The method requires that, at least after one toner image is formed on the front surface of the element, all further imagewise exposures are carried out through the transparent conductive substrate (i.e., through the rear surface of the element), rather than through the toner image previously formed on the front surface. Thus, no exposure is attempted to be carried out through previously formed toner images, and the potential problems thereof are completely avoided. However, such a method does require that a high-quality conductive substrate that is transparent and non-scattering to the actinic radiation be provided, which may in some cases be difficult or inefficient to accomplish, depending, for example, on the particular actinic radiation desired to be employed. It would be desirable to avoid the need for such a substrate.

U.S. Pat. No. 4,510,223 also describes forming a plurality of toner images in overlapping configuration on an electrophotographic element. The imaging exposures are carried out with a tungsten-filament visible light source equipped with a 480 nanometer broad band filter, the visible light of which is filtered imagewise through a different separation negative for each exposure. It is stated that sufficient exposures are made through previously formed toner images that do not adversely affect the latent image desired to be produced. The reasons for this are also stated. Previous toner images are formed in layers "thin enough to have a degree of transparency" to the exposing radiation. A large degree of transparency in such toner images is not necessary, since the intention is to produce half-tone images by completely discharging the photoconductor in each area exposed. Thus, the method uses an excess of visible exposing radiation overall in order to ensure that enough visible radiation will reach the photoconductor to completely discharge the exposed areas, even though the radiation may have been significantly attenuated by previously formed toner images in some areas. The patent teaches orders of multiple imaging, wherein the first toner image formed is always a black toner image. Of course, the amount of visible radiant energy that is sufficient to punch through a partially transparent toner in some areas (e.g., a black toner) and completely discharge the photoconductor in those areas, is much more than enough to effect such complete discharge in areas having no previously formed toner. Thus, while such a method may avoid false imaging due to previous toner images, it does so by wasting energy through overexposure of untoned areas; and the method cannot be used to form continuous-tone images that depend on gradations of toner deposition height, rather than area coverage, to give visual impressions of differing degrees of visual density, because the only possible results of the method are no toner image dots (in areas of no discharge because of no exposure) or maximum density toner image dots (in areas of complete discharge because of high exposure).

It would be desirable to provide an electrophotographic method of forming a plurality of overlapping toner images, wherein imagewise exposures could be carried out through previously formed toner images without adverse attenuation of the actinic exposing radiation and without wasting energy by overexposure, and wherein the method could be used to provide continuous-tone or half-tone images, as desired. The present invention provides such a method.

SUMMARY OF THE INVENTION

The invention provides an electrophotographic method of forming a subsequent toner image overlapping one or more toner images previously formed on a surface of an electrophotographic element and the method comprises the steps of:

(a) electrically charging the surface and the previously formed toner image or images, (b) forming an electrostatic latent image overlapping the previously formed toner image or images on the surface by imagewise exposing the element, through the previously formed toner image or images, to actinic radiation of a wavelength outside the range of 400 to 700 nanometers; the density of the previously formed toner image or images to the actinic radiation being less than about 0.2, and (c) electrographically developing the electrostatic latent image to thereby form the subsequent toner image.

Because the method employs actinic radiation of a wavelength outside the visible spectrum, and previously formed toner images have density of less than 0.2 to the actinic radiation, there is no adverse significant attenuation of the actinic exposing radiation by previously formed toner images and no need to waste energy through overexposure of previously untoned surface areas. Also, since the actinic radiation can be modulated in accordance with the visual density pattern of the image desired to be produced without any significant interference from previously formed toner images, the method can serve equally as well to produce continuous tone or halftone images.

As long as they have insignificant density to the actinic radiation (i.e., density less than about 0.2), toners can be chosen and deposited to accurately represent the visible hues and gradations of visible density of any visible image desired to be produced or reproduced. Thus, toner images having significant visible density (i.e., density of about 0.2 or greater) at any or all wavelengths in the visible spectrum can be accurately fashioned and can be electrophotographically overlapped by equally accurate subsequent toner images, since subsequent imagewise actinic exposures will not be significantly non-uniformly attenuated thereby and will not produce false latent images..

In some embodiments of the invention an electrophotographic element is employed wherein the surface to be charged, exposed, and toned is the outer surface of a dielectric support releasably adhered to a photoconductive layer which is on an electrically conductive substrate. This enables the overlapping toner images to be completely transferred to a receiving element of choice (e.g., to paper chosen to simulate or be the same as printing press paper, or to transparent film in order to provide a transparent image record) by contacting the surface of the dielectric support, having the overlapping toner images thereon, with a receiving element and transferring the dielectric support and overlapping toner images to the receiving element to form an image record wherein the overlapping toner images are sandwiched between the dielectric support and the receiving element. Such an image record is also protected from abrasion or other image degradation that might otherwise be caused by contact with surrounding atmosphere or other external materials.

The method can be particularly advantageously employed to form color proofs, wherein each toner material can be chosen to provide a color accurately representative of an ultimate press run color, without interfering with subsequent electrostatic latent image formation.

DESCRIPTION OF PREFERRED EMBODIMENTS

Sufficient information has already been provided above to enable one skilled in the art of electrophotography to practice the invention, in general. However, the invention is further described below, with particular reference to certain preferred embodiments thereof.

Electrophotographic elements useful in the method of the invention are any of the known types of such elements, with the sole additional proviso that the photoconductive material be chosen, or be modified with sensitizing additives, to be sensitive to the particular actinic radiation of choice having significant intensity at a wavelength outside of the visible spectrum (i.e., a wavelength outside the range of 400 to 700 nanometers).

Electrophotographic elements having particularly advantageous utility are those containing a strippable dielectric support and are described, for example, in allowed U.S. patent application Ser. No. 773,528, filed Sept. 6, 1985 (which has been incorporated herein by reference), with the exception that there is no need to limit the choice of electrically conductive substrates to those that are transparent to the actinic radiation of choice (since imaging exposures are not carried out through the conductive substrate in the present method), and with the proviso that the choice of photoconductive materials must be coordinated with the choice of a particular actinic radiation to be employed.

In some preferred embodiments of the method of the invention the wavelength of actinic radiation falls in the near-infrared region of the spectrum, i.e., in the range from greater than 700 nanometers to less than or equal to 1000 nanometers. Photoconductive layers having sensitivity to near-infrared radiation are well known in the art. See, for example, U.S. Pat. Nos. 4,337,305; 4,418,135; and 3,793,313.

In some particularly preferred embodiments the wavelength of actinic radiation is about 830 nm, and the photoconductive layer of the electrophotographic element contains as a photoconductor either a compound having the structure:

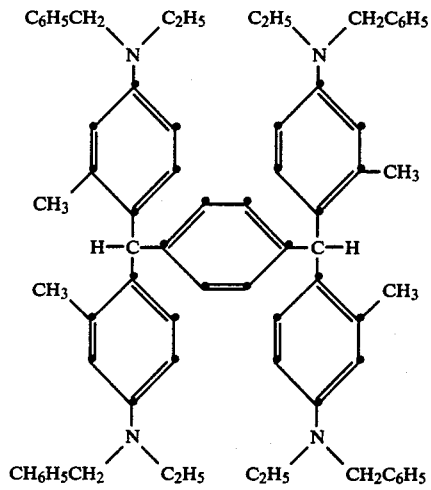

I or a compound having the structure:

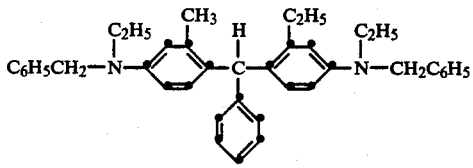

II and also contains a near-infrared sensitizer comprising 2-(2-(2-chloro-3-(2-(1-methyl-3,3-dimethyl-5-nitro-3H-indol-2-ylidene)ethylidene)-1-cyclohexenl-yl)ethenyl)-1-methyl-3,3-dimethyl-5-nitro-3H-indolium hexafluorophosphate.

Electrographic developers useful in the method of the invention are any of the known types of such developers (such as single component dry developers comprising particulate toner material, dual component dry developers comprising particulate toner material and particulate carrier material, and liquid developers comprising particulate toner material dispersed in a liquid carrier medium), with the proviso that any developer material that remains on the electrophotographic element after development in other than the last development step (usually toner binder material and toner colorant) have insignificant density (i.e., density less than about 0.2) to the particular actinic radiation of choice that has significant intensity at a wavelength outside of the visible spectrum. As mentioned previously, in some preferred embodiments of the method of the invention the wavelength of actinic radiation falls in the near-infrared region of the spectrum.

Many known toner binder materials have insignificant density to near-infrared radiation and are thus useful in such embodiments. One class of such useful binders comprises polyesters comprising recurring diol-derived units and recurring diacid-derived units, e.g., polyester binders having one or more aliphatic, alicyclic or aromatic dicarboxylic acid-derived recurring units, and recurring diol-derived units of the formula:

$$-O-G^1-O- \qquad \text{III}$$

wherein:

$G^1$ represents straight- or branched-chain alkylene having about 2 to 12 carbon atoms or cycloalkylene, cycloakylenebis(oxyalkylene) or cycloalkylenedialkylene.

Especially preferred polyesters are those which have up to 35 mole percent (based on the total moles of diacid units) of ionic diacid-derived units of the structure:

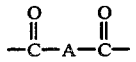

IV wherein:

A represents sulfoarylene, sulfoaryloxyarylene, sulfocycloalkylene, arylsulfonyliminosulfonylarylene, iminobis(sulfonylarylene), sulfoaryloxysulfonylarylene and sulfoaralkylarylene or the alkali metal or ammonium salts thereof. The diol- or diacid-derived units set forth above can be unsubstituted or substituted as desired.

Such preferred polyester resins include, for example, the polyester ionomer resins disclosed in U.S. Pat. No. 4,202,785 and the linear polyesters described in U.S. Pat. No. 4,052,325, the disclosures of which are hereby incorporated herein by reference.

Other useful toner binder resins include acrylic binder resins (e.g., as disclosed in U.S. Pat. Nos. 3,788,995 and 3,849,165), other vinyl resins, styrene resins, and many others well known in the art.

Many known toner colorant materials (dyes or pigments) have insignificant density to near-infrared radiation and are thus useful in some preferred embodiments of the method of the invention. It will be appreciated that most yellow and magenta colorants and many cyan colorants, chosen to have peak densities within the visible spectrum, will have insignificant density to near-infrared radiation. The choice of an appropriate black toner colorant, however, presents a bit more difficulty, since most known black colorants, (e.g., the carbon black colorants) also have significant density to near-infrared radiation.

Fortunately, a class of black colorants has been unexpectedly found to serve as good toner colorants yielding a truly black appearance, yet having insignificant density to near-infrared radiation. Such black colorants have the structure:

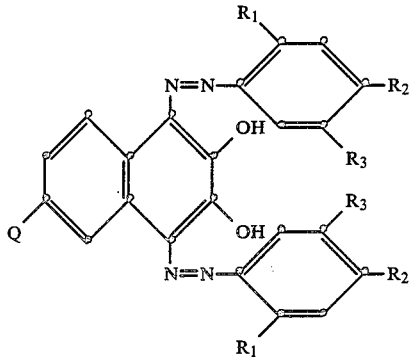

V wherein

Q is H or —$SO_3M$, wherein M is $NH_4$ or an alkali metal;

$R_1$ is H or alkoxy having 1 to 4 carbon atoms;

$R_2$ is H, —$OCH_2CONH_2$, or alkoxy having 1 to 4 carbon atoms;

$R_3$ is H, —$NO_2$, or —$SO_2NHR_4$ wherein $R_4$ is H, alkyl having 1 to 4 carbon atoms, phenyl, naphthyl, or alkyl-substituted phenyl or naphthyl wherein the alkyl has 1 to 4 carbon atoms. Black colorants of this type and their preparation are described in U.S. Pat. Nos. 4,414,152 and 4,145,299. Specific examples of such useful black colorants are those wherein:

each of Q, $R_2$, and $R_3$ is H, and $R_1$ is —$OCH_3$;

each of $R_2$ and $R_3$ is H, Q is —$SO_3Na$, and $R_1$ is —$OCH_3$;

each of Q, $R_1$, and $R_3$ is H, and $R_2$ is —$OCH_3$;

each of Q, $R_1$ and $R_3$ is H, and $R_2$ is —$OCH_2CONH_2$;

each of Q and $R_2$ is H, $R_1$ is —$OCH_3$, and $R_3$ is —$SO_2NH_2$;

each of Q and $R_2$ is H, $R_1$ is $OCH_3$, and $R_3$ is —$NO_2$; or each of Q, $R_1$ and $R_2$ is H, and $R_3$ is —$NO_2$.

In some particularly preferred embodiments of the method of the invention the wavelength of actinic radiation is about 830 nm. Specific examples of useful toner colorants having less than about 0.2 density to 830 nm radiation are:

the cyan colorant having the structure

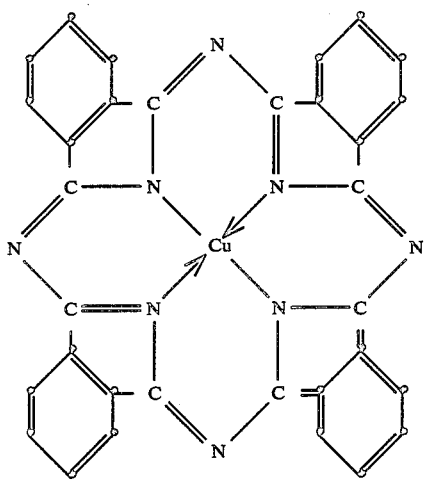

VI (available from Sun Chemical Co., USA);

the magenta colorant having the structure:

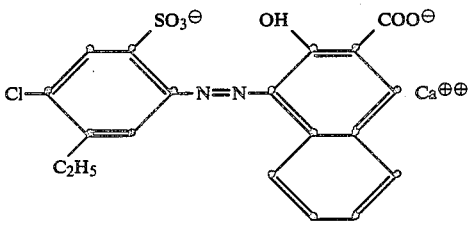

VII which is also available from Sun Chemical Co.;

the yellow colorant having the structure:

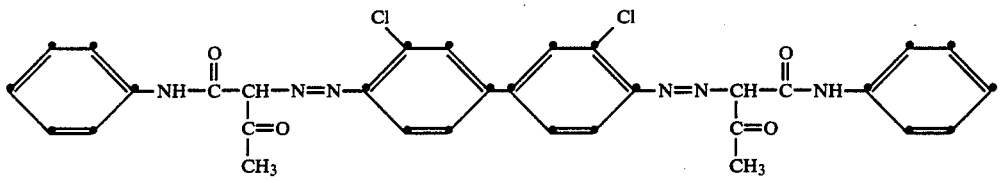

VIII

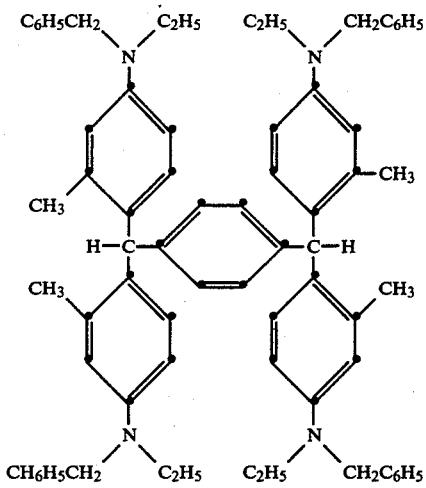

I (available from the Hoechst Chemical Co. and the Sherwin Williams Co.); and the black colorants described above, especially 1,4-bis(o-anisylazo)-2,3-naphthalenediol.

In preferred embodiments of the method of the invention, wherein the actinic radiation is near-infrared radiation, such radiation can be provided, for example, by filtering a wide-spectrum radiation source to allow only the near-infrared portion through, or by initially creating radiation having only near-infrared components, e.g., by means of a laser diode. In particularly preferred embodiments, wherein 830 nm radiation is used, such radiation can be easily provided by an AlGaAs laser diode, widely available from many sources.

In carrying out imagewise exposures in the method of the invention while using, for example, a laser diode near-infrared radiation source in a laser scanning apparatus (of which many are known; see, for example, copending U.S. patent application Ser. No. 848,427, 1 filed 4 Apr. 1986, the disclosure of which is hereby incorporated herein by reference), the actinic radiation can be easily modulated imagewise by any well known method, such as by interposing an imagewise mask in the beam of radiation or by modulating the output of the laser diode in accordance with imagewise information contained in a stream of electronic signals by well known means.

The following Example is presented to further illustrate a preferred mode of practice of the method of the invention.

EXAMPLE

An electrophotographic element was prepared having the following structure.

A poly(ethylene terephthalate) substrate was overcoated with a conductive layer comprising cuprous iodide and a polymeric binder. The conductive layer was overcoated with a photoconductive layer containing, in a polymeric binder, a photoconductive material having the structure:

and a near-infrared sensitizer comprising 2-(2-(2-chloro-3-(2-(1-methyl-3,3-dimethyl-5-nitro-3H-indol-2-ylidene)ethylidene)-1-cyclohexen-1-yl)ethenyl)-1-methyl-3,3-dimethyl-5-nitro-3H-indolium hexafluorophosphate. The ratio of photoconductor/sensitizer/binder by weight was 48/1/160. The photoconductive layer was overcoated with a releasable dielectric support comprising 16 parts by weight poly(vinyl acetate) and 4 parts by weight cellulose acetate butyrate. A release fluid was also included in the photoconductive layer to aid in later stripping the dielectric support from the rest of the element.

The outer surface of the dielectric support was charged to +500 volts and subjected, through a halftone screen, to an imagewise exposure of actinic radiation having a wavelength of 830 nm. The imagewise exposure was effected by an AlGaAs laser diode in a scanning apparatus as described in copending U.S. patent application Ser. No. 848,427, filed 4 Apr. 1986, the disclosure of which has been incorporated herein by reference. The laser diode output intensity was modulated imagewise, electronically, corresponding to a black image desired to be produced. The scanning density was 71 scan lines per mm.

The resultant electrostatic latent image was developed electrophoretically with a liquid developer comprising toner particles of the black colorant, 1,4-bis(o-anisylazo)-2,3-naphthalenediol, and polyester toner binder (of the type described in U.S. Pat. No. 4,202,785), dispersed in the electrically insulating organic carrier liquid, Isopar G TM (a volatile isoparaffinic hydrocarbon having a boiling point range from about 145° to 185° C., trademarked by and available from Exxon Corporation, USA). The resultant black toner image on the dielectric support had a truly black appearance, having density of at least 0.24 to light of any wavelength within the visible spectrum and having density of less than 0.07 to radiation at the near-infrared wavelength of 830 nm.

Any remaining charge on the dielectric support was then erased by exposure of the electrophotographic element to wide-spectrum radiation. The outer surface of the dielectric support and black toner image was then uniformly recharged to +500 volts and exposed to the scanning laser radiation as in the first imaging cycle, except that in this case the laser diode output intensity was modulated imagewise, electronically, corresponding to a yellow image desired to be produced in registration with the black image, and had to pass through the black toner image in some surface areas in order to reach the electrophotographic element.

The resultant electrostatic latent image was developed electrophoretically with a liquid developer as in the first imaging cycle, except that, instead of the black colorant, a yellow colorant having the structure:

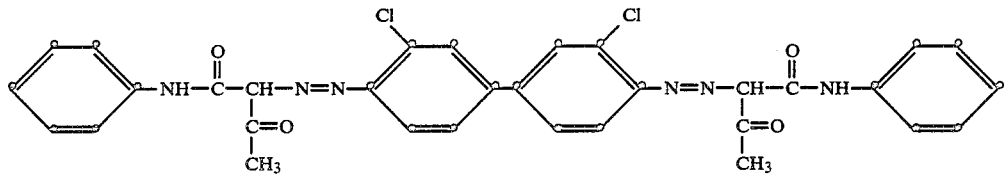

VIII was included in the toner particles. The resulting yellow toner image overlapped the black toner image on the dielectric support and exhibited no false imaging.

The composite black and yellow toner image had density of at least 0.27 to light of any wavelength within the visible spectrum and had density of less than 0.09 to radiation at the near-infrared wavelength of 830 nm.

The outer surface of the dielectric support and composite black and yellow toner image was then charge-erased, uniformly recharged to +500 volts, and exposed to the scanning laser radiation as in the previous imaging cycles; except that the laser diode output intensity was modulated imagewise, electronically, corresponding to a magenta image desired to be produced in registration with the composite black and yellow image, and had to pass through the overlapping black and yellow toner images in some surface areas in order to reach the electrophotographic element.

The resultant electrostatic latent image was developed electrophoretically with a liquid developer as in the previous imaging cycles, except that the colorant included in the toner particles was a magenta colorant having the structure:

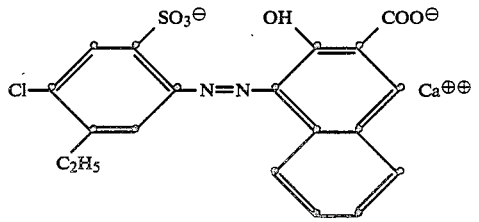

VII

The resulting magenta toner image overlapped the black and yellow toner images on the dielectric support and exhibited no false imaging. The composite of overlapping black, yellow, and magenta toner images had density of at least 0.3 to light of any wavelength within the visible spectrum and had density of less than 0.11 to radiation at the near-infrared wavelength of 830 nm.

The outer surface of the dielectric support and composite black, yellow, and magenta toner image was then charge-erased, uniformly recharged to +500 volts, and exposed to the scanning laser radiation as in the previous imaging cycles; except that the laser diode output intensity was modulated imagewise, electronically, corresponding to a cyan image desired to be produced in registration with the composite black, yellow, and magenta image, and had to pass through the overlapping black, yellow, and magenta toner images in some surface areas in order to reach the electrophotographic element.

The resultant electrostatic latent image was developed electrophoretically with a liquid developer as in the previous imaging cycles, except that the colorant included in the toner particles was a cyan colorant having the structure:

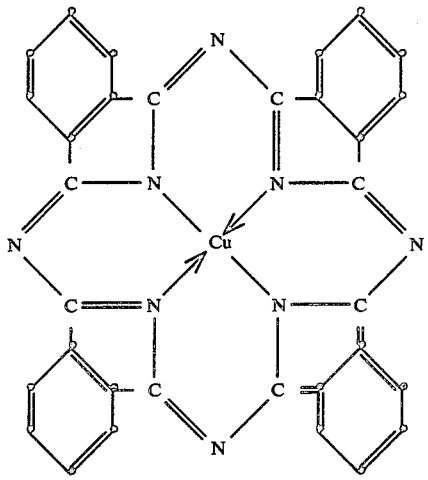

VI

The resulting cyan toner image overlapped the black, yellow, and magenta images on the dielectric support and exhibited no false imaging.

The electrophotographic element bearing the multicolor toner image was then moved to a separate lamination device comprising heated metal and rubber rolls, together forming a nip. The electrophotographic element was passed through the nip along with a white receiver paper against which the toner image-bearing dielectric support surface was pressed, at a roll temperature of 103° C. and a pressure of 225 pounds per square inch (1.551 MPa) to effect lamination of the dielectric support and composite image to the receiver followed by peeling off the rest of the electrophotographic element. The result was a multicolor toner image sandwiched between a white paper background and the dielectric support.

Although the invention has been described in detail with particular reference to certain preferred embodiments thereof, it should be appreciated that variations and modifications can be effected within the spirit and scope of the invention.

What is claimed is:

1. An electrophotographic method of forming a subsequent toner image overlapping one or more toner images previously formed on a surface of an electrophotographic element, said method comprising the steps of:
   (a) electrically charging the surface and the previously formed toner image or images,
   (b) forming an electrostatic latent image overlapping the previously formed toner image or images on the surface by imagewise exposing the element, through the previously formed toner image or images, to actinic radiation of a wavelength outside the range of 400 to 700 nanometers; the density of the previously formed toner image or images to the actinic radiation being less than 0.2, and
   (c) electrographically developing the electrostatic latent image to thereby form the subsequent toner image.

2. The electrophotographic method of claim 1, wherein the wavelength of the actinic radiation is greater than 700 nanometers and less than or equal to 1000 nanometers.

3. The electrophotographic method of claim 1, wherein the wavelength of the actinic radiation is about 830 nanometers.

4. The electrophotographic method of claim 1, wherein the actinic radiation is created by a laser diode.

5. The electrophotographic method of claim 1, wherein the electrographic developing is carried out with a liquid electrographic developer.

6. The electrophotographic method of claim 1, wherein the previously formed toner image or images have a density of at least 0.2 to light having wavelengths throughout the range of 400 to 700 nanometers.

7. The electrophotographic method of claim 6, wherein at least one of the previously formed toner images is a black toner image.

8. The electrophotographic method of claim 7, wherein the black toner image comprises a black colorant having the structure:

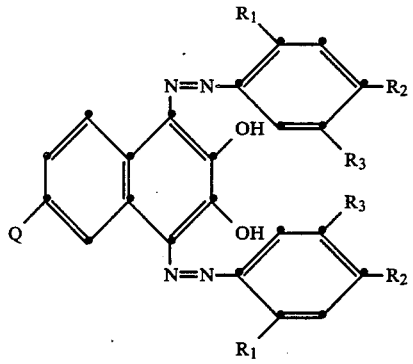

wherein:

Q is H or —$SO_3M$, wherein M is an alkali metal or $NH_4$;

$R_1$ is H or alkoxy having 1 to 4 carbon atoms;

$R_2$ is H, —$OCH_2CONH_2$, or alkoxy having 1 to 4 carbon atoms;

$R_3$ is H, —$NO_2$, or —$SO_2NHR_4$ wherein $R_4$ is H, alkyl having 1 to 4 carbon atoms, phenyl, naphthyl, or alkyl-substituted phenyl or naphthyl wherein the alkyl has 1 to 4 carbon atoms.

9. The electrophotographic method of claim 8, wherein:

each of Q, $R_2$, and $R_3$ is H, and $R_1$ is —$OCH_3$;

each of $R_2$ and $R_3$ is H, Q is —$SO_3Na$, and $R_1$ is —$OCH_3$;

each of Q, $R_1$, and $R_3$ is H, and $R_2$ is —$OCH_3$;

each of Q, $R_1$, and $R_3$ is H, and $R_2$ is —$OCH_2CONH_2$;

each of Q and $R_2$ is H, $R_1$ is —$OCH_3$, and $R_3$ is —$SO_2NH_2$;

each of Q and $R_2$ is H, $R_1$ is —$OCH_3$, and $R_3$ is —$NO_2$; or each of Q, $R_1$, and $R_2$ is H, and $R_3$ is —$NO_2$.

10. The electrophotographic method of claim 8, wherein each of Q, $R_2$, and $R_3$ is H, and $R_1$ is —$OCH_3$.

11. The electrophotographic method of claim 6, wherein the previously formed toner images comprise a black toner image overlapped by a yellow toner image.

12. The electrophotographic method of claim 6, wherein the prevsiously formed toner images comprise a black toner image, overlapped by a yellow toner image, which are in turn overlapped by a magenta toner image.

13. The electrophotographic method of claim 1, wherein the electrophotographic element surface referred to in claim 1 is the outer surface of a dielectric support releasably adhered to a photoconductive layer which is on an electrically conductive substrate.

14. The electrophotographic method of claim 13, further comprising the subsequent steps of:
   (d) contacting the surface of the dielectric support, having the overlapping toner images thereon, with a receiving element, and
   (e) transferring the dielectric support and overlapping toner images to the receiving element.

15. A process of forming a multicolor proof, comprising the electrophotographic method of claim 12, wherein the subsequent toner image comprises a cyano toner image, the surface bearing the toner images is the outer surface of a dielectric support releasably adhered to a photoconductive layer which is on an electrically conductive substrate, and the method further comprises the steps of:
   (d) contacting the surface of the dielectric support, having the overlapping toner images thereon, with a receiving element, and
   (e) transferring the dielectric support and overlapping toner images to the receiving element to form the multicolor proof.

* * * * *